US007581803B2

(12) United States Patent
Shinohara

(10) Patent No.: US 7,581,803 B2
(45) Date of Patent: Sep. 1, 2009

(54) IMAGE FORMING APPARATUS, METHOD AND COMPUTER READABLE MEDIUM FOR EXECUTING PREDETERMINED ERROR PROCESSES IN RESPONSE TO A MOVEABLE MEMBER ERROR

(75) Inventor: Tadashi Shinohara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 193 days.

(21) Appl. No.: 10/927,162

(22) Filed: Aug. 27, 2004

(65) Prior Publication Data

US 2005/0088505 A1 Apr. 28, 2005

(30) Foreign Application Priority Data

Aug. 28, 2003 (JP) ..... 2003-304442

(51) Int. Cl.
*B41J 29/38* (2006.01)
*G03G 15/01* (2006.01)

(52) U.S. Cl. ..... 347/16; 347/104; 399/18; 399/179

(58) Field of Classification Search ..... 347/16, 347/153, 154
See application file for complete search history.

(56) References Cited

U.S. PATENT DOCUMENTS 4,275,968 A * 6/1981 Irwin ..... 400/582
4,873,541 A * 10/1989 Hirose et al. ..... 347/118
5,502,544 A 3/1996 Carolan
5,621,221 A 4/1997 Shinohara et al.
5,737,665 A 4/1998 Sugiyama et al.
5,765,083 A 6/1998 Shinohara
5,875,380 A 2/1999 Iwata et al.
5,899,597 A 5/1999 Shinohara et al.
5,962,783 A 10/1999 Iwata et al.
5,963,240 A 10/1999 Shinohara et al.
6,118,557 A 9/2000 Sugiyama et al.
6,128,459 A 10/2000 Iwata et al.
6,201,944 B1 * 3/2001 Onuki et al. ..... 347/117
6,282,396 B1 8/2001 Iwata et al.
6,295,435 B1 9/2001 Shinohara et al.
6,302,514 B1 * 10/2001 Eade et al. ..... 347/33

(Continued)

FOREIGN PATENT DOCUMENTS

EP 1 482 383 A1 12/2004

(Continued)

OTHER PUBLICATIONS

U.S. Appl. No. 10/927,162, filed Aug. 27, 2004, Shinohara.

(Continued)

*Primary Examiner*—Matthew Luu
*Assistant Examiner*—Shelby Fidler
(74) *Attorney, Agent, or Firm*—Oblon, Spivak, McClelland, Maier & Neustadt, P.C.

(57) ABSTRACT

In an image forming apparatus, an image forming unit includes a movable member that is rotationally driven by a driving unit. A moving distance or a moving speed of the movable member is detected. The driving unit is controlled based on a quantity of control. An occurrence of a detection error or a control error is determined based on the moving distance, the moving speed, or the quantity of control. A predetermined error process is executed if an error occurs.

20 Claims, 11 Drawing Sheets

U.S. PATENT DOCUMENTS

| | | | | |
|---|---|---|---|---|
| 6,380,960 | B1 | 4/2002 | Shinohara | |
| 6,381,435 | B2 | 4/2002 | Shinohara et al. | |
| 6,573,918 | B2 | 6/2003 | Kobayashi et al. | |
| 6,587,137 | B2 | 7/2003 | Shinohara et al. | |
| 6,693,654 | B2 | 2/2004 | Shinohara | |
| 6,704,035 | B2 | 3/2004 | Kobayashi et al. | |
| 6,711,364 | B2 | 3/2004 | Shinohara | |
| 6,714,224 | B2 | 3/2004 | Yamanaka et al. | |
| 6,805,425 | B2 * | 10/2004 | Hayashi et al. | 347/16 |
| 6,916,081 | B2 * | 7/2005 | Nakashima | 347/32 |
| 2001/0017989 | A1 * | 8/2001 | Tamai et al. | 399/16 |
| 2002/0104393 | A1 * | 8/2002 | Van Es et al. | 74/87 |
| 2005/0088505 | A1 | 4/2005 | Shinohara | |

FOREIGN PATENT DOCUMENTS

| | | |
|---|---|---|
| JP | 11-24507 | 1/1999 |
| JP | 11-146675 | 5/1999 |
| JP | 2001-13747 | 1/2001 |
| JP | 2001-96873 | 4/2001 |

OTHER PUBLICATIONS

U.S. Appl. No. 11/340,645, filed Jan. 27, 2006, Shinohara.
U.S. Appl. No. 11/496,510, filed Aug. 1, 2006, Shinohara.
U.S. Appl. No. 11/555,476, filed Nov. 1, 2006, Shinohara.
U.S. Appl. No. 11/557,289, filed Nov. 7, 2006.

* cited by examiner

IMAGE FORMING APPARATUS, METHOD AND COMPUTER READABLE MEDIUM FOR EXECUTING PREDETERMINED ERROR PROCESSES IN RESPONSE TO A MOVEABLE MEMBER ERROR

CROSS-REFERENCE TO RELATED APPLICATIONS

The present document incorporates by reference the entire contents of Japanese priority document, 2003-304442 filed in Japan on Aug. 28, 2003.

BACKGROUND OF THE INVENTION

1) Field of the Invention

The present invention relates to an image forming apparatus such as a facsimile, a printer, a copying machine, or a multifunction product and, more particularly, to an image forming apparatus which transfers a visual image on an image carrier to a movable object side such as a conveyer belt or an intermediate transfer belt at a counter position between the image carrier and the movable object.

2) Description of the Related Art

In recent years, a color image forming apparatus that forms a high-quality image has gained popularity both at home and abroad. In particular, a tandem type color image forming apparatus, in which a plurality of image forming units are arranged along a conveyer unit to realize an image forming process at a high speed, is popular.

In the tandem type color image forming apparatus, optical beams emitted from a plurality of light sources are irradiated on the plurality of image carriers arranged in the apparatus, to form an electrostatic latent image. Developing agents having different colors (for example, toners of three colors: yellow (Y), magenta (M), and cyan (C), or of the three colors and black (Bk)) are caused to adhere to the electrostatic latent images, to form toner images that serve as real images. Thereafter, a recording material such as recording paper or the like, carried on the movable object such as a conveyer belt, is sequentially conveyed to transfer positions of the image carriers. The toner images are superimposed on the recording material to transfer the image. The transferred toner image is fixed on the recording material to form a multi-color image.

In the color image forming apparatus, the toner image is transferred at a high speed, onto the recording material such as a recording paper moving in the conveyance direction. Feedback control may be performed with respect to the moving speed of the movable body, to stabilize positioning accuracy of the respective colors.

Japanese Unexamined Patent Publication No. H11-146675 discloses an image forming apparatus that determines an error when a speed error of the conveyer belt drive motor or a positioning error exceeds a tolerance value, and stops photoconductor members and a transfer belt.

Japanese Unexamined Patent Publication No. H11-24507 discloses an image forming apparatus that performs drive source control based on results obtained by reading scales formed on the rotating member (transfer belt), and performs feedback control of the speed of the transfer belt, to position images on the transfer member with high accuracy.

However, due to the following problems in execution of the feedback control, an erroneous image may be output.

As the first problem, when a toothless output pulse is generated from an out-of-order encoder, a decrease in speed or lack of a position forward distance is detected. Thus, when the feedback control is performed in this state, the rotating speed of a motor that rotationally drives a movable member increases excessively.

As the second problem, when noise is superimposed on an encoder output, it is detected that a speed increases or that a position forward distance is excessive. Hence, when the feedback control is performed in this state, the rotating speed of the motor that rotationally drives the movable member reduces excessively.

As the third problem, when movement of the movable member suddenly varies, the rotating speed of the motor that rotationally drives the movable member excessively increases or reduces. Depending on circumstances, control oscillation can occur.

In Japanese Unexamined Patent Publication No. H11-146675 stated above, when a control error is detected by comparing the speed error tolerance with the positioning error tolerance, the photoconductor members and the transfer belt are stopped.

However, the problems are unique to when the feedback control is performed. If the feedback control is not performed, though color shift may worsen slightly, a user can obtain an image having practically no problem. Therefore, prohibiting image formation without reason results in downtime of the image forming apparatus, which some users do not like.

SUMMARY OF THE INVENTION

It is an object of the present invention to at least solve the problems in the conventional technology.

An image forming apparatus according to an aspect of the present invention includes an image forming unit that forms an image; a movable member; a driving unit that rotationally drives the movable member; a moving information detecting unit that detects any one of a moving distance and a moving speed of the movable member; a deviation information calculating unit that calculates any one of a position deviation based on the moving distance detected, and a speed deviation based on the moving speed detected; a drive controlling unit that provides control of any one of the position deviation calculated and the speed deviation calculated, to control the driving unit based on a quantity of control; an error determining unit that determines an occurrence of any one of a detection error and a control error, based on any one of the moving distance detected, the moving speed detected, and the quantity of control; and an error process executing unit that executes a predetermined error process if the error determining unit determines that there is an error.

An image forming method according to another aspect of the present invention includes mask period deciding including deciding whether a control error decision mask period selected from among through up, a settling & transfer contact period, a transfer spacing period, and through down, is set; pulse interval deciding including deciding whether an encoder pulse interval falls within a predetermined range, if the control error decision mask period is not selected at the mask period deciding; prohibition deciding including deciding whether an image formation prohibition process is selected as a process after an error decision, if it is decided at the pulse interval deciding that the encoder pulse interval does not fall within the predetermined range; prohibiting the image formation prohibition process, if it is decided at the prohibition deciding that the image formation prohibition process is selected; and stopping feedback control and rotating a drive motor at a predetermined speed, if it is decided at the prohibition deciding that the image formation prohibition process is not selected.

A computer-readable recording medium according to still another aspect of the present invention records thereon a computer program that realizes the above image forming method on a computer.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus, an image forming method, and a computer product according to the present invention are explained below, with reference to the accompanying drawings.

Figure 9:
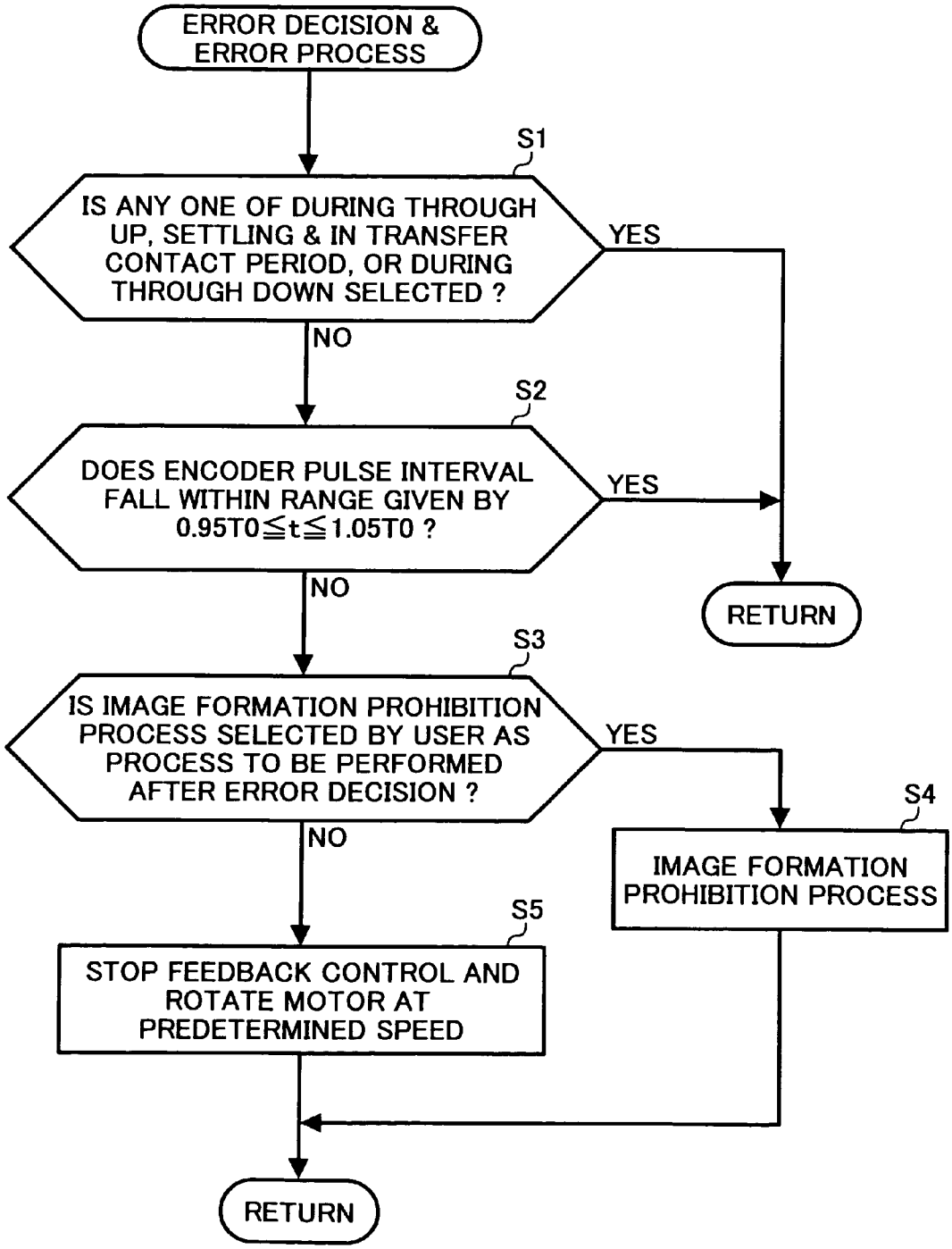
FIG. 9 is a graph of a running sequence of a drive motor.

An operation of an image forming apparatus is described first, with reference to FIG. 9. The image forming apparatus according to the present invention decides whether a control error decision mask period selected from among through up, a settling & transfer contact period, a transfer spacing period, and through down is set (step S1). If the control error decision mask period is set, the process is shifted to RETURN. If the control error decision mask period is not set, it is determined whether an encoder pulse interval falls within the range given by $0.95T0 \leqq t \leqq 1.05T0$ (Equation 1) (step S2). If the encoder pulse interval falls within the range given by Equation 1, the process is shifted to RETURN. If the encoder pulse interval does not fall within the range given by Equation 1, it is determined whether an image formation prohibition process is selected as a post process (step S3). If the image formation prohibition process is selected, the image formation prohibition process is performed (step S4), and the process is shifted to RETURN. If the image formation prohibition process is not selected, feedback control is stopped, a drive motor (stepping motor) is rotated at a predetermined speed (step S5), and the process is shifted to RETURN. In step S2, although error decisions are performed at an encoder pulse interval, the error decisions can also be performed by decisions performed at a drive pulse frequency of a drive motor 22 (stepping motor).

A tandem type color image forming apparatus according to the present invention is described below with reference to FIG. 1.

In the tandem type color image forming apparatus, image forming units 6Y (yellow), 6M (magenta), 6C (cyan), and 6BK (black) of respective colors are sequentially aligned from the upstream side in the conveying direction of a conveyer belt 5 which conveys a sheet of paper 4 separated and fed from a paper feed tray 1 by a paper feed roller 2 and a separation roller 3.

These image forming units 6Y, 6M, 6C, and 6BK have identical internal configuration except for colors of toner images to be formed. The image forming unit 6Y, the image forming unit 6M, the image forming unit 6C, and the image forming unit 6BK form a yellow image, a magenta image, a cyan image, and a black image, respectively.

Therefore, in the following explanation, the image forming unit 6Y will be concretely described. Because the other image forming units 6M, 6C, and 6BK are similar to the image forming unit 6Y, with respect to the constituent elements of the image forming units, 6M, 6C, and 6BK, only symbols discriminated by M, C, and BK are described in FIG. 1 in place of Y added to the constituent elements of the image forming unit 6Y, and a description thereof will be omitted.

The conveyer belt 5 is an endless belt wound on a drive roller 7 and a driven roller 8 which are rotationally driven. In image formation, the sheets of paper 4 stored on the paper feed tray 1 are sequentially fed from the top, adsorbed to the conveyer belt 5 by electrostatic adsorption, and conveyed to the image forming unit 6Y, serving as the first image forming unit, by the rotatably driven conveyer belt 5. In the image forming unit 6Y, a yellow toner image is transferred to the sheet of paper.

The image forming unit 6Y includes a photoconductor drum 9Y serving as a photosensitive object, and an electric charging unit 10Y, an exposing unit 11, a developing unit 12Y, a photoconductor cleaner (not shown), and a neutralizer 13Y arranged around the photoconductor drum 9Y. The exposing unit 11 is designed to irradiate laser beams 14Y, 14M, 14C, and 14BK serving as exposure beams corresponding to image colors formed by the image forming units 6Y, 6M, 6C, and 6BK, respectively.

In image formation, the outer peripheral surface of the image forming unit 6Y is uniformly electrically charged by the electric charging unit 10Y in the dark, exposed by the laser beam 14Y emitted from the exposing unit 11, and an electrostatic latent image corresponding to a yellow image is formed. This electrostatic latent image is changed into a visible image by yellow toner in the developing unit 12Y, to form a yellow toner image on the photoconductor drum 9Y.

The toner image is transferred onto the sheet of paper 4 by the operation of a transferring unit 15Y at a position where the photoconductor drum 9Y is in contact with the sheet of paper 4 on the conveyer belt 5, to form a yellow image on the sheet of paper 4. On completion of transferring the yellow image, unnecessary toner left on the outer peripheral surface of the photoconductor drum 9Y is wiped out by the photoconductor cleaner. Thereafter, the photoconductor drum 9Y is neutralized by the neutralizer 13Y for the next image formation.

In this manner, the sheet of paper 4 onto which the yellow toner image is transferred by the image forming unit 6Y is conveyed to the next image forming unit 6M along the conveyer belt 5. In the image forming unit 6M, by the same process as performed by the image forming unit 6Y, a magenta toner image is formed on the photoconductor drum 9M, and the toner image is transferred onto the sheet of paper 4 to superimpose the images. The sheet of paper 4 is conveyed to the next image forming units 6C and 6BK, and a cyan toner image formed on a photoconductor drum 9C and a black toner image formed on a photoconductor drum 9BK are transferred onto the sheet of paper 4 to superimpose the images. In this manner, a full-color superimposed image is transferred onto the sheet of paper 4. The sheet of paper 4 on which the full-color superimposed image is formed is removed from the conveyer belt 5, and the superimposed image is fixed onto the sheet of paper 4 by a fixing unit 16. Thereafter, the sheet of paper 4 is discharged.

In the color image forming apparatus, there may be error in center distances between the photoconductor drums 9Y, 9M, 9C, and 9BK, error in parallelism of the photoconductor drums 9Y, 9M, 9C, and 9BK, error in installation of polarizing mirrors (not shown) that polarize laser beams in the exposing unit 11, error in write timing of electrostatic latent images on the photoconductor drums 9Y, 9M, 9C, and 9BK, and fluctuation in the conveyance speed of the conveyer belt 5, and the like. Consequently, the toner images of the respective colors are not superimposed at a predetermined position where the toner images are supposed to be superimposed, and position errors occur.

Therefore, in the color image forming apparatus, the position errors of the color toner images to be formed must be corrected. Thus, on the opposite side of the conveyer belt 5, sensors 17, 18, and 19 are arranged on the downstream side of the image forming unit 6BK to detect and correct static position errors (DC components). The sensors 17, 18, and 19 are supported and arranged on one substrate in a main scan direction perpendicular to the direction of an arrow (moving direction of the conveyer belt) shown in FIG. 1. A rotary encoder 20 is attached to the rotating shaft of the driven roller 8 to detect and correct dynamic position errors (AC components) caused by the fluctuation of conveyance speed of the conveyer belt 5, so that feedback control is performed to the drive motor 22 serving as a drive source of the drive roller 7.

Figure 2:
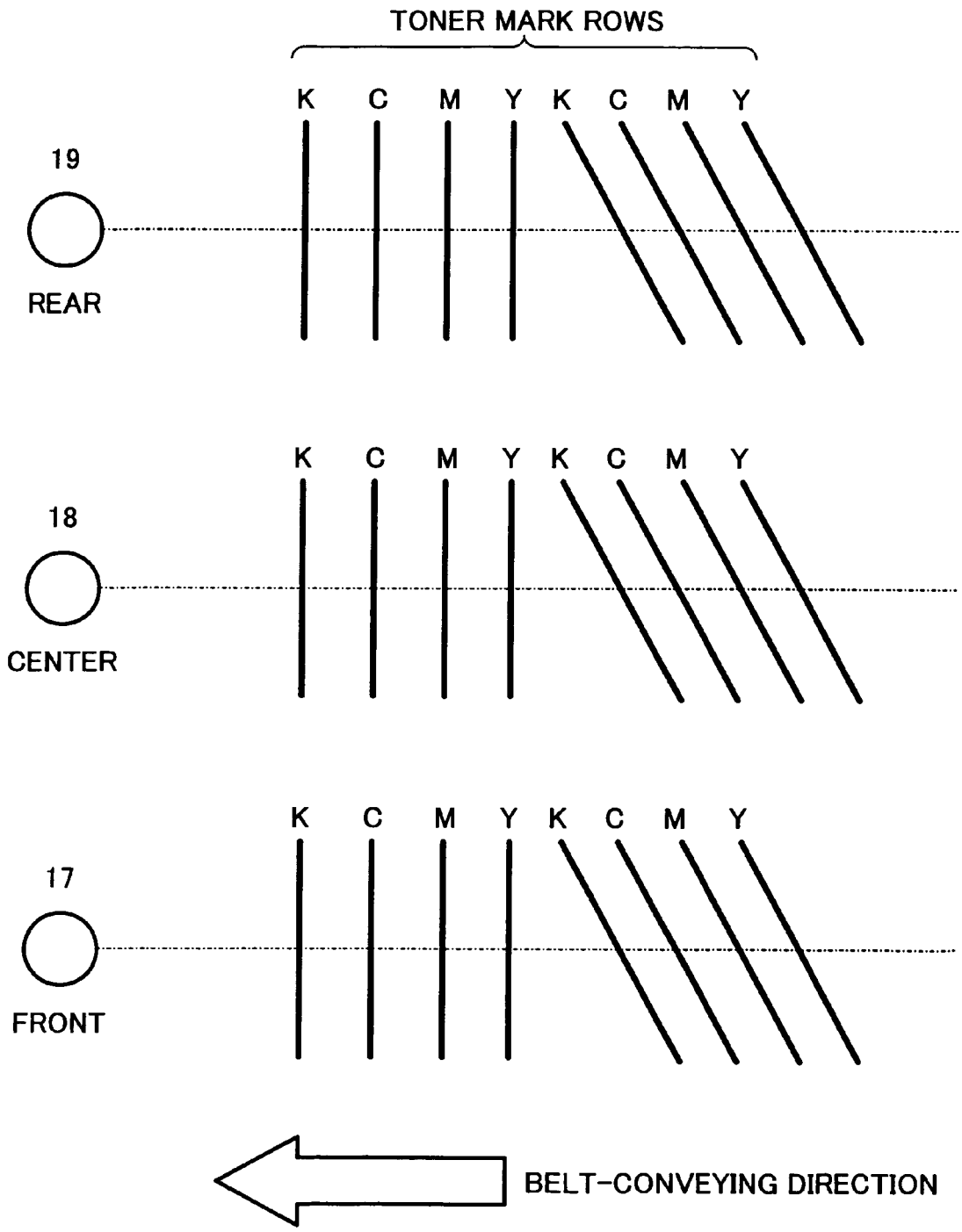
FIG. 2 is an example of toner mark rows for alignment.

As components of the position errors of the respective colors, the following are known:

skew error resist error in sub-scan direction resist error in main scan direction magnification error in main scan direction FIG. 2 depicts an example of alignment toner mark rows formed on the conveyer belt 5. On the conveyer belt 5, transverse lines and oblique lines K, C, M, and Y are formed. The transverse and oblique lines are detected by the sensors 17, 18, and 19 arranged in the main scan direction (direction perpendicular to the belt direction), to measure skew errors to a reference color (in this case, BK), resist errors in the sub-scan direction, resistor errors in the main scan direction, and magnification errors in the main scan direction. From the measurements, various shift lengths and quantities of correction are calculated. A CPU (described later) corrects the error components as follows.

The skew errors are corrected by changing inclinations of mirrors (not shown) that reflect the laser beams of the respective colors in the exposing unit 11. As a drive source to bias the mirrors, a stepping motor is used.

Figure 3:
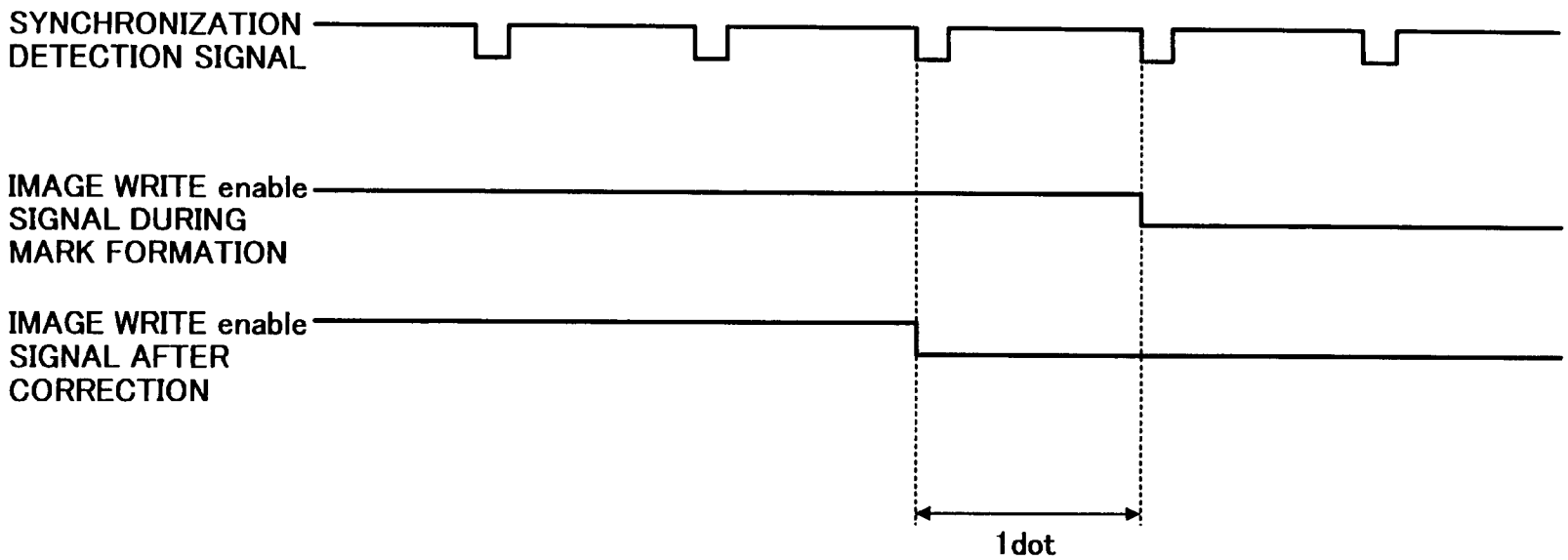
FIG. 3 is a timing chart that is obtained when write timing in a sub-scan direction is corrected.

Correction of a resist error in the sub-scan direction is explained with reference to a timing chart, obtained when write timings in the sub-scan direction are corrected, as shown in FIG. 3. In this case, a correction resolution is set at 1 dot. An image region signal (write enable signal) in the sub-scan direction controls writing at a timing of a synchronization detection signal. When it is desired to forward a write position by 1 dot as a result of mark detection and calculation, the write enable signal may be made active one-synchronization signal ahead of the timing of the original write enable signal.

Figure 4:
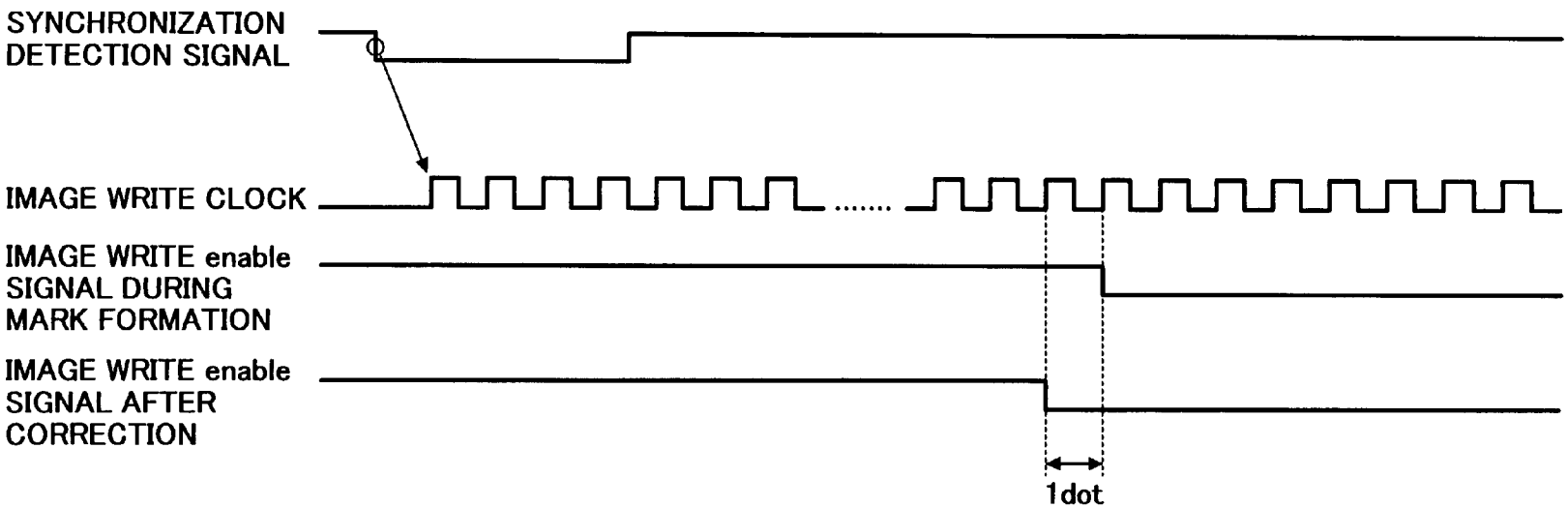
FIG. 4 is a timing chart that is obtained when write timing in a main scan direction is corrected.

Correction of a resist error in the main scan direction is explained with reference to a timing chart, obtained when write timing in the main scan direction is corrected, as shown in FIG. 4. In this case, a correction resolution is set at 1 dot. As image write clocks, clocks having accurately equal phases are obtained in each line by a trailing edge of a synchronization detection signal. An image is written in synchronization with the clock signal. However, the image write enable signal in the main scan direction is also formed in synchronization with the clock signal. When it is desired to forward a write position by 1 dot as a result of mark detection and calculation, the write enable signal may be made active one clock ahead of the timing of the original write enable signal. In addition, when a magnification in the main scan direction shifts with respect to a reference color, the magnification can be changed by using a device which can change a frequency in fine steps, e.g., a clock generator which uses a VCO (Voltage Controlled Oscillator) or a PLL (Phase Locked Loop).

The correction process is executed in the following cases:

The correction process is executed in initialization performed immediately after a power supply is turned on.

The correction process is automatically executed when a temperature at a predetermined position, e.g., at a part of the exposing unit 11 in the image forming apparatus, is equal to or larger than a predetermined temperature when an increase in temperature at the position is monitored.

The correction process is automatically executed immediately after a print operation for sheets of paper the number of which is larger than a predetermined number.

The correction process is executed when a user initiates the execution of the correction process through an operation panel or a printer driver.

Figure 1:
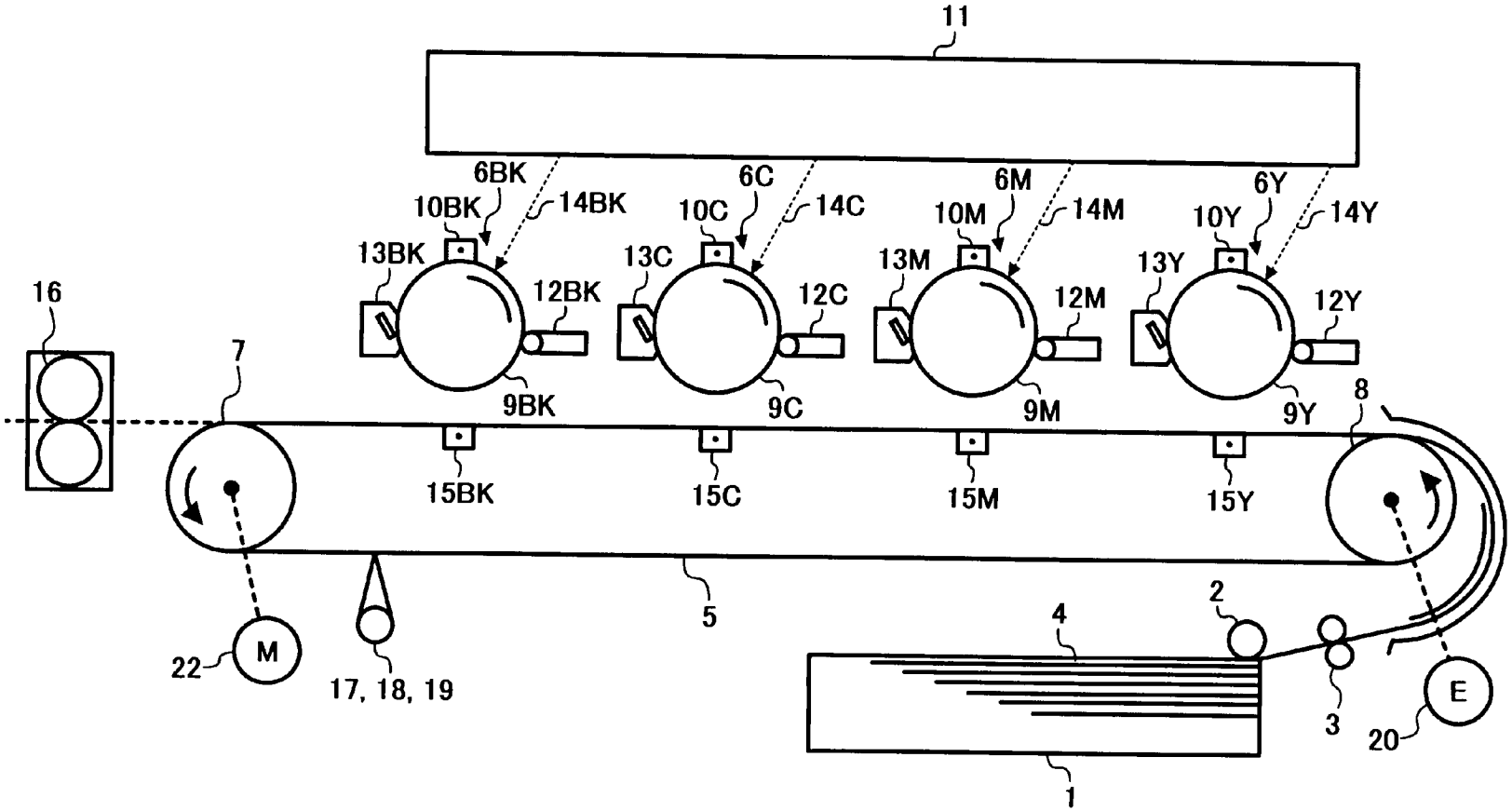
FIG. 1 illustrates a configuration of an image forming apparatus according to a first embodiment of the present invention.
Figure 5:
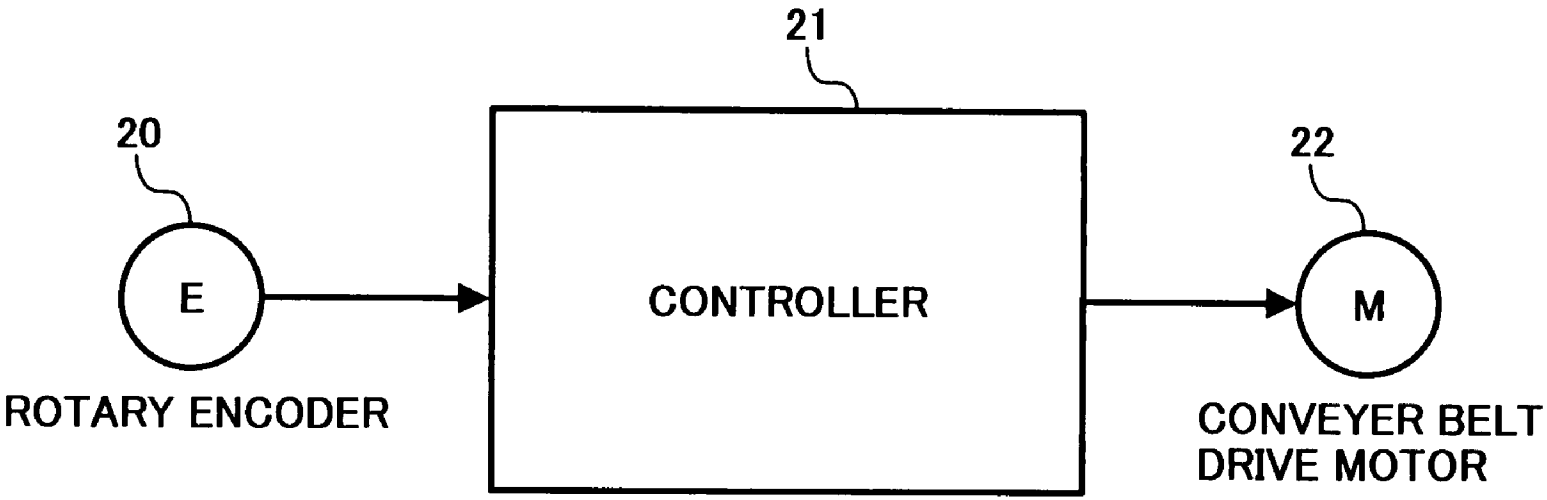
FIG. 5 is a functional block diagram of a process of stabilizing movement properties of a conveyer belt.

FIG. 5 depicts a functional block diagram of a process of stabilizing movement properties of the conveyer belt 5 shown in FIG. 1. Based on a detection result detected by a rotary encoder 20, a controller 21 calculates a speed deviation with respect to a target speed or a position deviation with respect to a target position to stabilize the conveyer belt. The calculated speed deviation or the position deviation is subjected to a PI control calculation to control the drive motor 22 serving as a drive source of the drive roller 7 that moves the conveyer belt 5. In this manner, in the image forming apparatus according to the present invention, a feedback loop is constructed for the conveyer belt 5.

Figure 6:
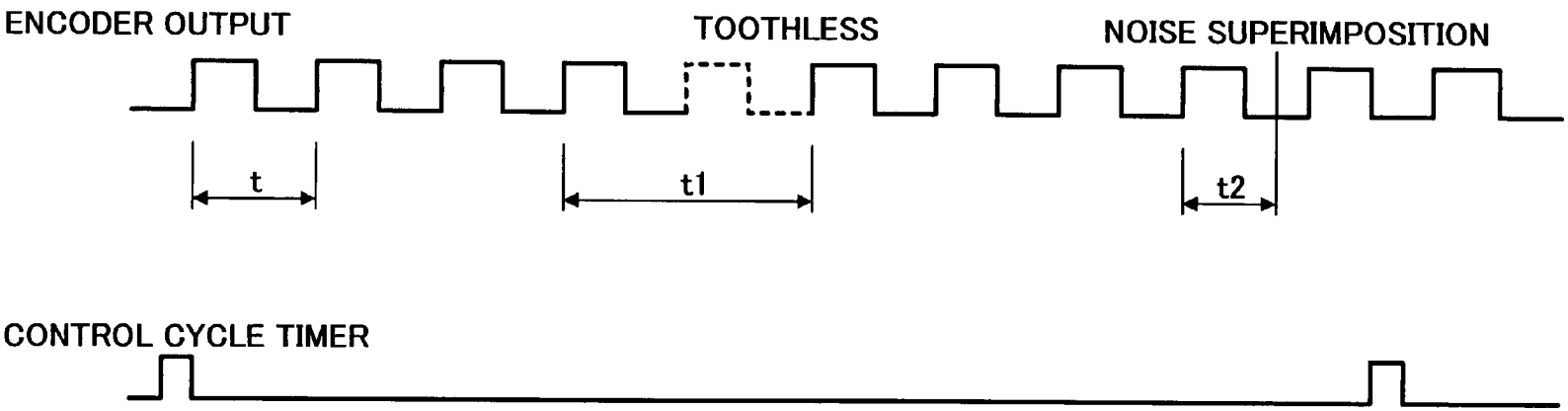
FIG. 6 illustrates a relationship between encoder output pulses and a control cycle timer.
Figure 7:
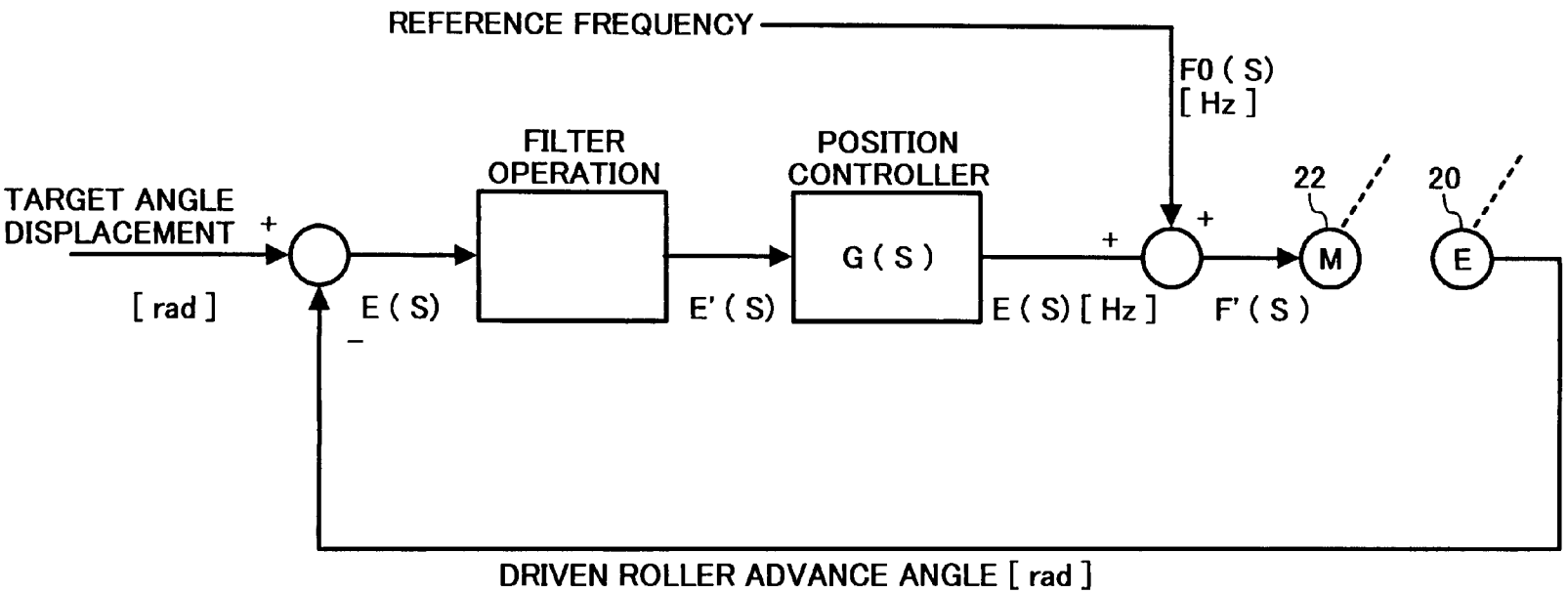
FIG. 7 is a functional block diagram of a control process performed in the image forming apparatus.

The first embodiment of the present invention will be described below. In the first embodiment, it is assumed that a stepping motor is used as the drive motor 22 shown in FIG. 1. FIG. 6 illustrates a relationship between encoder output pulses string output according to movement of the conveyer belt and a control cycle timer that performs feedback control. FIG. 7 is a block diagram of functions of a control process performed in the image forming apparatus.

In the control process performed in the image forming apparatus in this embodiment, a driven roller advance angle [rad] is calculated from the number of encoder output pulses at a leading edge of the control cycle timer shown in FIG. 6, and compared with a target angle displacement [rad]. An obtained deviation [E(S)] is subjected to filter operation (low-pass filter operation) to cut a high-frequency component to obtain a value [E'(S)]. Based on the value [E'(S)] and a position controller [G(S)], for example, a PI control calculation is performed to add [F(S)] and a reference frequency [F0(S)] to change a drive pulse frequency [F'(S)]. The driven roller 8 and the conveyer belt 5 shown in FIG. 1 are designed such that the driven roller 8 does not slip on the conveyer belt 5, and an angular displacement and a moving distance of the conveyer belt 5 are equivalent to each other.

A method of detecting a control error on the basis of a detection result detected by the rotary encoder 20 attached to the shaft of the driven roller 8 will be described below.

Time (t[s]) of an interval between the leading edges of encoder output pulses shown in FIG. 6 is measured. It is decided whether the measured time falls within the range given by the equation (1) given below. If an average time interval of t is given by T0[S], it is understood that time (t) of a leading edge interval falls within a fluctuation range of 5% that can be considered in practical use. If the time t satisfies the following condition given by equation (1), there is no problem.

$$0.95T0 \leqq t \leqq 1.05T0 \quad (1)$$

However, if it is decided that the time (t) does not fall within the range-given by equation (1), an error process (described later) is performed.

Because a pulse interval t1 obtained when a toothless encoder output shown in FIG. 6 is generated does not fall within the range given by equation (1), the pulse interval t1 is determined as an error. Because a pulse interval t2 obtained when noise is superimposed on the encoder output does not fall within the range given by equation (1), the pulse interval t2 is determined as an error.

In FIG. 6, a process of calculating a quantity of control of the drive motor 22 (stepping motor) shown in FIG. 1 and setting the quantity of control is performed every control cycle timer. However, it is assumed that the average frequency of the drive frequency is represented by f0 [pps], it is understood that the drive frequency (f) falls within a fluctuation range of 5% that can be considered in practical use. When the frequency (f) satisfies the following condition given by equation (2), there is no problem.

$$0.95F0 \leqq f \leqq 1.05f0 \quad (2)$$

However, if it is decided that the frequency (f) does not fall within the range given by (2), an error process (described later) is performed.

When a toothless encoder output shown in FIG. 6 is generated, and when noise is superimposed on the encoder output, the obtained drive frequency (f) does not fall within the range given by (2). Therefore, an error is decided.

Since a control error can be decided by any one of the decision made by the encoder output pulse and the decision made by the drive pulse frequency, either method can be applied without any problem.

A running process operation in image formation will be described below with reference to FIG. 8.

Figure 8:
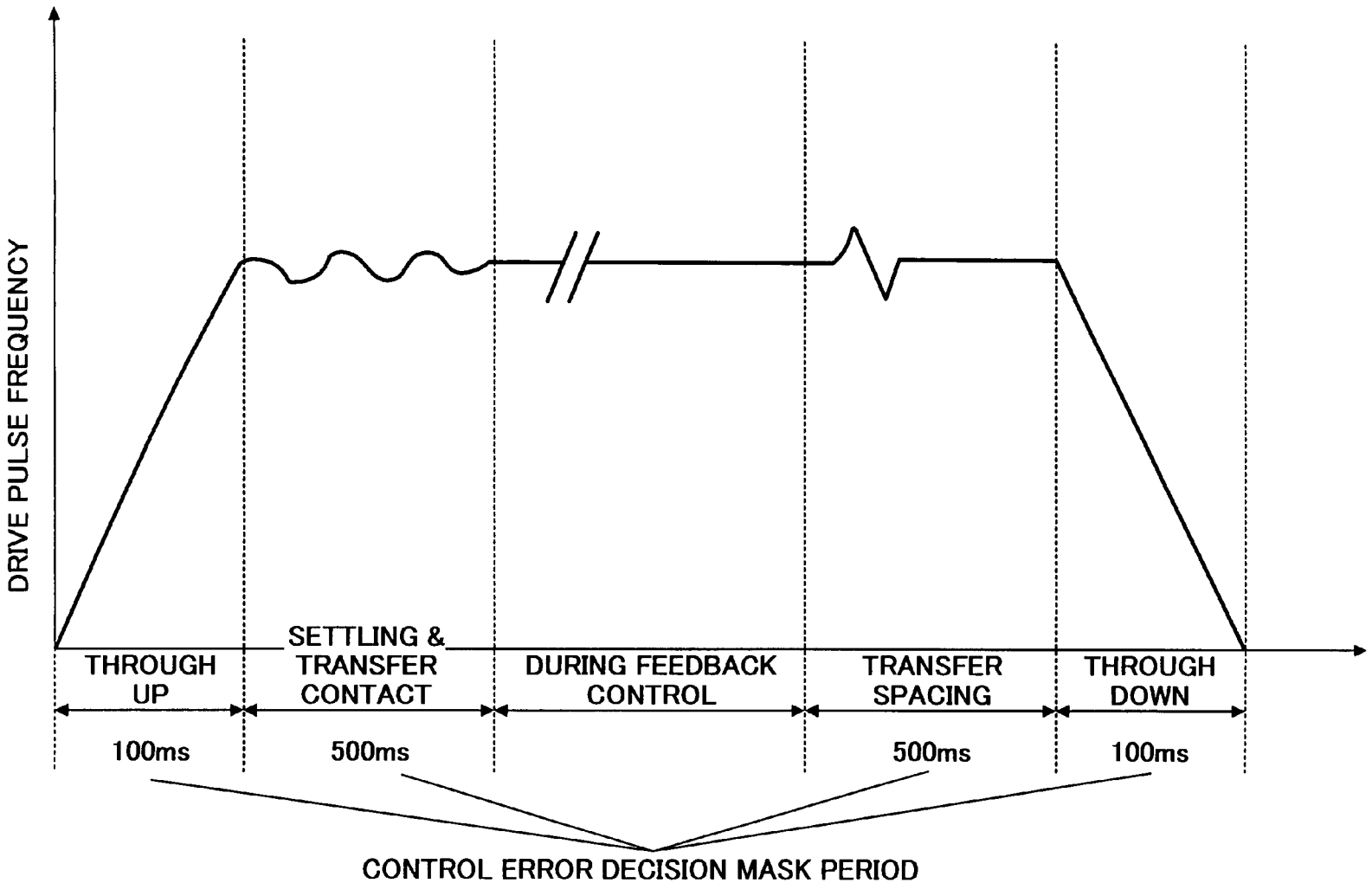
FIG. 8 is a flow chart of a process procedure of an error decision process and an error process.

FIG. 8 is a graph of a running sequence of the drive motor 22 (stepping motor) that performs full-color printing during image formation. A conveyer belt of the image forming apparatus is always in contact with the black photoconductor 9BK. However, the conveyer belt has a contacting/separating mechanism (not shown) that separates the conveyer belt from the C, M, and Y photoconductors 9C, 9M, and 9Y during printing for BK, and brings the conveyer belt into contact with the photoconductors 9C, 9M, and 9Y during full-color printing.

Through up is performed for 100 ms, 500 ms is required as a settling & transfer contact period, and then general feedback control is performed. Upon completion of printing, transfer spacing is performed for 500 ms, and through down is performed for 100 ms.

It is determined that the error decision is not performed during the through up, in which a process of activating and stopping the drive motor 22 (stepping motor) is performed, and during the transfer spacing.

It is understood that movement of the belt is unstable in the settling & transfer contact period, and during the through down. Because the error decision conditions are satisfied in these periods, the error decision is not performed in these periods.

The error process is a process of switching a state in which the drive motor 22 (stepping motor) is subjected to feedback control based on the detection result detected by the rotary encoder 20 shown in FIG. 1 to a state in which the drive motor 22 (stepping motor) is rotated at a constant speed and a predetermined drive pulse frequency without being subjected to the feedback control. In this manner, since the drive motor 22 (stepping motor) is not subjected to the feedback control, a color shift may be slightly deteriorated. However, some user may accept such an image. When such a user is prohibited to form an image without reason, downtime of the image forming apparatus is produced. The downtime is not preferable for the position of a user.

The error process may be a process of prohibiting image formation. Since some user desires to output only high-quality images being free from color shift, such a user is prohibited to form an image when the control error is decided.

As the error process performed when the control error is decided, a process of stopping the feedback control of the drive motor 22 (stepping motor) and switching the drive motor (stepping motor) to the motor at a constant speed and a predetermined drive pulse frequency, and a process of prohibiting image formation can be selected to cope with the needs of various users.

It is assumed that the error process is performed when a predetermined error occurs a predetermined number of times. In general, an error occurs even once, an erroneous image is output. The number of times for the error decision is set at 1.

The error process is restored such that normal feedback control is performed by turning on/off the power supply of the image forming apparatus. This is because noise superimposition may not be infrequently eliminated since, for example, noise superimposition or the like may occur due to an influence of another apparatus located around the image forming apparatus by accident, due to a situation of power supply, or the like.

FIG. 9 is a program flowchart of a process procedure of an error decision process and an error process.

It is decided whether any control error decision mask period selected from among through up, a settling & transfer contact period, a transfer spacing period, and through down shown in FIG. 8 is set (step S1).

If any control error decision mask period is set (Yes at step S1), the process is shifted to RETURN. If any control error decision mask period is not set (No at step S1), it is determined whether an encoder pulse interval falls within the range given by $0.95T0 \leqq t \leqq 1.05T0$(step S2).

If the encoder pulse interval falls within the range given by $0.95T0 \leqq t \leqq 1.05T0$ (Yes at step S2), the process is shifted to RETURN. If the encoder pulse interval does not fall within the range given by $0.95T0 \leqq t \leqq 1.05T0$ (NO in step S2), it is determined whether an image formation prohibition process is selected by a user as a process to be performed after the error decision (step S3).

If the image formation prohibition process is selected (Yes at step S3), the image formation prohibition process is performed (step S4), and the process is shifted to RETURN. If the image formation prohibition process is not selected (No at step S3), the feedback control is stopped, the drive motor (stepping motor) is rotated at a predetermined speed (step S5), and the process is shifted to RETURN.

In step S2, the error decision is performed at the encoder pulse interval. However, the error decision can be performed at the drive pulse frequency of the drive motor 22 (stepping motor).

Figure 10:
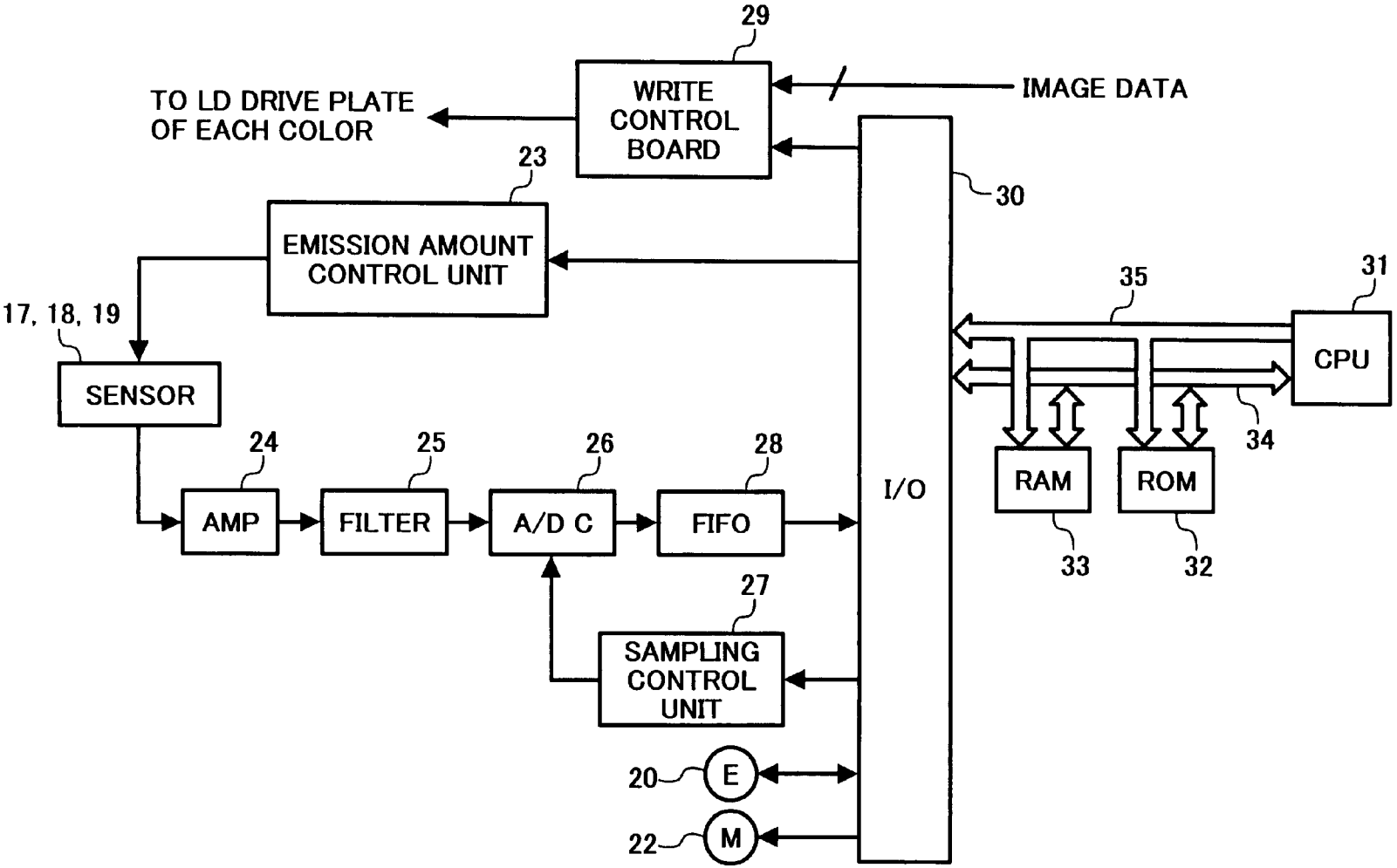
FIG. 10 illustrates a configuration of various control units in the image forming apparatus.

FIG. 10 illustrates a configuration of various control units in the image forming apparatus.

Each of the sensors 17, 18, and 19 includes a light-emitting element (not shown) and a light-receiving element (not shown) that are controlled by an emission amount controlling unit 23. The output side of the sensor is connected to an I/O port 30 through an AMP 24, a filter 25, an A/D converter 26, and an FIFO memory 28. The AMP 24 amplifies detection signals obtained by the sensors 17, 18, and 19. The amplified signals pass through the filter 25, and are converted by the A/D converter 26 from analog data into digital data. The sampling controlling unit 27 controls sampling of the data, and the FIFO memory 28 stores the sampling data.

The sampling controlling unit 27, the FIFO memory 28, and the write control board 29 are connected to the I/O port 30. The rotary encoder 20 is also connected to the I/O port 30 to control an ON/OFF operation of the light-emitting unit. An output pulse is connected to the I/O port 30. The drive motor 22, which drives the drive roller that moves the conveyer belt, is also connected to the I/O port 30 to form a feedback control loop.

The I/O port 30, a CPU 31, a ROM 32, and a RAM 33 are interconnected by a data bus 34 and an address bus 35.

In the ROM 32, various programs such as a program to calculate various positional shift lengths of toner images, and a program to perform feedback control are stored. The address bus 35 designates a ROM address, a RAM address, and various input/output devices.

The CPU 31 monitors detection signals from the sensors 17, 18, and 19 at predetermined timings. Emission amounts of the light-emitting elements of the sensors 17, 18, and 19 are controlled by the emission amount control unit 23, to reliably detect toner images even though deterioration or the like of the conveyer belt 5 shown in FIG. 1 and the light-emitting elements of the sensors 17, 18, and 19 occurs, so that the output levels of light-emitting signals from the light-emitting elements are always constant.

The CPU 31 performs setting for the write control board 29 based on quantities of correction calculated from detection results of position detection toner marks, to change a main resist and a sub-resist and to change an image frequency based on a magnification error. The write control board 29 includes devices, which can very finely set output frequencies, such as clock generators using, e.g., VCOs (Voltage Controlled Oscillators) for the respective colors including the reference color. Outputs from the devices are used as image clocks. The CPU 31 also controls a skew controlling stepping motor (not shown) in the exposing unit 11 shown in FIG. 1, based on the quantities of correction calculated from the detection results of the position detection toner marks.

In addition, the CPU 31 measures pulses from an encoder output pulse to calculate a current position deviation to a target position, performs, a PI control calculation or the like to the position deviation, and outputs the obtained quantity of control to the drive motor 22 to stabilize the traveling of the conveyer belt. In this feedback control, an error decision and an error process shown in the flow chart of FIG. 9 are performed.

Figure 11:
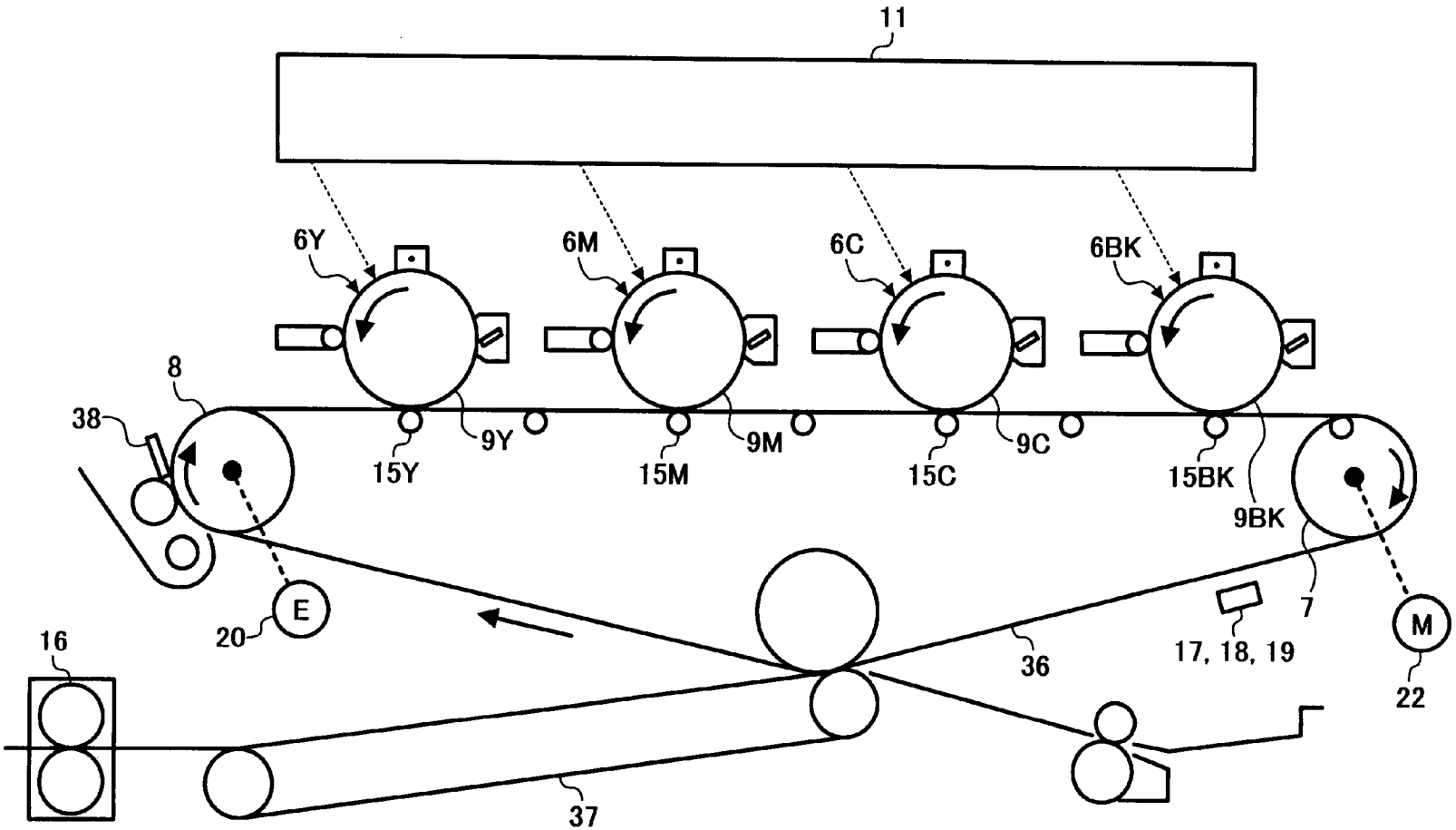
FIG. 11 illustrates a configuration of an image forming apparatus according to a second embodiment.

An image forming apparatus according to a second embodiment will be described below with reference to FIG. 11.

The image forming apparatus according to the second embodiment has the following configuration. That is, an intermediate transfer belt 36 is arranged as an intermediate transfer member in place of the conveyer belt 5 in the image forming apparatus according to the first embodiment. Images formed by image forming units 6Y, 6M, 6C, and 6BK are temporarily transferred onto the intermediate transfer belt 36, and the images on the intermediate transfer belt 36 are transferred onto a sheet of paper by a transfer belt 37 serving as a transferring unit. The transfer belt 37 also includes a function of conveying a sheet of paper to a fixing unit 16. A cleaning unit for the intermediate transfer belt 36 is indicated by reference numeral 38.

A toner mark forming unit according to the invention forms position detection toner marks of respective colors on the intermediate transfer belt 36. Thus, as in FIG. 1, sensors 17, 18, and 19 are aligned in a main scan direction perpendicular to a rotating direction of the intermediate transfer belt 36. The direction of an arrow shown in FIG. 11 corresponding to the rotating direction of the intermediate transfer belt 36, and the direction perpendicular to the direction of the arrow corresponds to the main scan direction in which the sensors 17, 18, and 19 are aligned. All the position detection toner marks are formed at positions detected by the sensors 17, 18, and 19. By the image forming apparatus including the transfer belt shown in FIG. 11, the positions of the position detection toner marks on the intermediate transfer belt 36 are detected, so that the positions of images formed on photoconductor drums 9Y, 9M, 9C, and 9BK can be corrected.

Further, the image forming apparatus includes a drive roller 7 and a driven roller 8 like the image forming apparatus shown in FIG. 1. A rotary encoder 20 is attached to the shaft of the driven roller 8 as in FIG. 1. A drive motor 22 is controlled based on detection results to constitute a feedback loop, and movement of the intermediate transfer belt 36 is stabilized.

The embodiments are preferable embodiments of the present invention. Various modifications of the embodiments can be effected without departing from the spirit and scope of the invention. For example, laser beams are applied as the exposing light sources in the embodiments. However, the light sources are not limited to the laser beams. For example, an LED array or the like can also be used. Furthermore, detection of the speed and position of the belt may be performed by using not only the rotary encoder attached to the shaft of the driven roller, but also by a configuration that detects a scale or toner marks formed on the upper or lower surface of the belt. Although the stepping motor is used as the drive motor, the drive motor is not limited to the stepping motor, and a DC motor, an AC motor, or the like can also be used. In addition, although PI control is applied as a control calculation performed by the controller, the control operation is not limited to the PI control, and P control, PID control, H∞ control, or the like can also be applied.

An image forming apparatus according to the present invention performs a detected error decision in detection of a movable member and a control error decision in control of a driving unit on the basis of a moving distance or a moving speed of the movable member, and performs a predetermined error process when an error is determined, to prevent erroneous position control and erroneous speed control from being performed.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

an image forming unit configured to form an image;

a movable member that is a transfer conveyer belt or is an intermediate transfer belt;

a driving unit configured to rotationally drive the movable member and to be subjected to feedback control;

a moving information detecting unit configured to detect a moving distance or a moving speed of the movable member;

a deviation information calculating unit configured to calculate a position deviation based on the moving distance detected or a speed deviation based on the moving speed detected;

a drive controlling unit configured to provide control of the position deviation calculated or the speed deviation calculated, to control the driving unit based on a quantity of control;

an error determining unit configured to determine an occurrence of a detection error or a control error, based on one of the moving distance detected, the moving speed detected, and the quantity of control; and an error process executing unit configured to execute, when the error determining unit determines the occurrence of the detection error or the control error, a first predetermined error process of switching the driving unit to rotate the driving unit at a predetermined speed and stopping feedback control of the driving unit only when a first mode has been selected by a user and a second predetermined error process only when a second mode has been selected by the user.

2. The image forming apparatus according to claim 1, wherein the error determining unit is configured to determine the occurrence of the detection error by checking whether a time interval, measured between output signals output from the moving information detecting unit, falls within a predetermined range.

3. The image forming apparatus according to claim 1, wherein the error determining unit is configured to determine the occurrence of the control error by checking whether the quantity of control falls within a predetermined range.

4. The image forming apparatus according to claim 1, wherein the second predetermined error process is a process of prohibiting image formation.

5. The image forming apparatus according to claim 1, wherein the first predetermined error process is executed when the occurrence of the detection error or the control error is determined a predetermined number of times.

6. The image forming apparatus according to claim 5, wherein the predetermined number of times is one.

7. The image forming apparatus according to claim 1, wherein when the error process executing unit executes the first predetermined error process, turning on/off a power supply restarts control of the driving unit.

8. The image forming apparatus according to claim 1, wherein the error process executing unit is configured to neglect the occurrence of the detection error or the control error, when the error determining unit determines the occurrence of the detection error or the control error, during a predetermined period.

9. The image forming apparatus according to claim 8, wherein the predetermined period is at least one of a period in which a rotation of the driving unit starts and a period in which the rotation of the driving unit stops.

10. The image forming apparatus according to claim 8, wherein the predetermined period is a period in which a variation in behavior of the movable member is predicted.

11. The image forming apparatus according to claim 10, wherein, the image forming unit includes a plurality of photoconductors, the movable member has a contacting/separating mechanism configured to contact the plurality of photoconductors and to separate from the plurality of photoconductors, and the predetermined period is a period before and after the contacting/separating mechanism contacts the plurality of photoconductors or separates from the plurality of photoconductors, or is a period after the contacting/separating mechanism contacts the plurality of photoconductors or separates from the plurality of photoconductors.

12. The image forming apparatus according to claim 11, wherein the contacting/separating mechanism is configured to separate from at least one fewer than all of the plurality of photoconductors.

13. An image forming method for an image forming apparatus controlled by a feedback control, comprising:

deciding whether a control error decision mask period has been set;

determining whether an encoder pulse interval falls within a predetermined range, if it is decided in the deciding step that the control error decision mask period has not been set;

evaluating whether an image formation prohibition process has been selected as a process after an error decision, if it is determined in the determining step that the encoder pulse interval does not fall within the predetermined range;

carrying out the image formation prohibition process, if it is determined in the evaluating step that the image formation prohibition process has been selected; and stopping the feedback control and rotating a drive motor at a predetermined speed, if it is determined in the evaluating step that the image formation prohibition process has not been selected.

14. The image forming method according to claim 13, further comprising:

neglecting that the encoder pulse interval does not fall within the predetermined range, if it is decided in the deciding step that the control error decision mask period has been set.

15. The image forming method according to claim 14, wherein the control error decision mask period is a period before and after a contacting/separating mechanism contacts a plurality of photoconductors or separates from the plurality of photoconductors, or is a period after the contacting/separating mechanism contacts the plurality of photoconductors or separates from the plurality of photoconductors.

16. The image forming method according to claim 13, wherein the control error decision mask period is at least one of a period in which a rotation of the drive motor starts and a period in which the rotation of the drive motor stops.

17. A computer-readable recording medium that records thereon a computer program including instructions, directed to an image forming apparatus controlled by feedback control, which instructions when executed, cause a computer to execute a method comprising:

deciding whether a control error decision mask period has been set;

determining whether an encoder pulse interval falls within a predetermined range, if it is decided that in the deciding step that the control error decision mask period has not been set;

evaluating whether an image formation prohibition process has been selected as a process after an error decision, if it is determined in the determining step that the encoder pulse interval does not fall within the predetermined range;

carrying out the image formation prohibition process, if it is determined in the evaluating step that the image formation prohibition process has been selected; and stopping the feedback control and rotating a drive motor at a predetermined speed, if it is determined in the evaluating step that the image formation prohibition process has not been selected.

18. The computer-readable recording medium according to claim 17, the method further comprising:

neglecting that the encoder pulse interval does not fall within the predetermined range, if it is decided in the deciding step that the control error decision mask period has been set.

19. The computer-readable recording medium according to claim 18, wherein the control error decision mask period is a period before and after a contacting/separating mechanism contacts a plurality of photoconductors or separates from the plurality of photoconductors, or is a period after the contacting/separating mechanism contacts the plurality of photoconductors or separates from the plurality of photoconductors.

20. The computer-readable recording medium according to claim 17, wherein the control error decision mask period is at least one of a period in which a rotation of the drive motor starts and a period in which the rotation of the drive motor stops.

* * * * *